US011412910B2

(12) United States Patent
Jung et al.

(10) Patent No.: US 11,412,910 B2
(45) Date of Patent: Aug. 16, 2022

(54) DISH WASHER

(71) Applicant: LG Electronics Inc., Seoul (KR)

(72) Inventors: Changyoon Jung, Seoul (KR); Sangheon Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 135 days.

(21) Appl. No.: 16/696,528

(22) Filed: Nov. 26, 2019

(65) Prior Publication Data

US 2020/0163520 A1 May 28, 2020

(30) Foreign Application Priority Data

Nov. 27, 2018 (KR) ..... 10-2018-0148962

(51) Int. Cl.
*A47L 15/00* (2006.01)
*A47L 15/42* (2006.01)

(52) U.S. Cl.
CPC ..... *A47L 15/0047* (2013.01); *A47L 15/0044* (2013.01); *A47L 15/4225* (2013.01); *A47L 15/4285* (2013.01); *A47L 15/4287* (2013.01)

(58) Field of Classification Search
CPC ..... A47L 15/4225; A47L 15/4285; A47L 15/0044; A47L 15/0047; A47L 15/4287; A47L 15/4291; A47L 15/4219; A47L 15/483; A47L 2401/12; A47L 2501/01; A47L 2501/06; A47L 2501/11; A47L 2501/20; A47L 2501/36
See application file for complete search history.

(56) References Cited

U.S. PATENT DOCUMENTS

2011/0203303 A1* 8/2011 Moure ..... F28F 9/22 62/324.1
2012/0167920 A1* 7/2012 Bertram ..... A47L 15/4285 134/18
2020/0187749 A1* 6/2020 Bertram ..... A47L 15/4291

FOREIGN PATENT DOCUMENTS

CH 699692 3/2010
DE 102015226481 6/2017
EP 2096203 A1 * 9/2009 ..... D06F 39/006
EP 2206824 A2 * 7/2010 ..... D06F 39/006
EP 2682037 3/2016
WO WO-2018215331 A1 * 11/2018 ..... A47L 15/4291

OTHER PUBLICATIONS

EP2206824A2 machine translation (Year: 2010).*
EP2096203A1 machine translation (Year: 2009).*
CH699692 machine translation (Year: 2010).*
DE102015226481 machine translation (Year: 2017).*
Office Action in German Appln. No. 102019131952.8, dated Feb. 3, 2022, 12 pages (with English translation).

* cited by examiner

*Primary Examiner* — Douglas Lee
(74) *Attorney, Agent, or Firm* — Fish & Richardson P.C.

(57) ABSTRACT

The present disclosure relates to a dish washer having a heat pump, and the dish washer may include a washing tank provided with a sump at a bottom surface thereof and provided with an accommodation space for storing dishes therein; a heat pump system provided with an evaporator, a compressor that compresses and circulates refrigerant, a condenser that heats washing water for washing the dishes, and an expansion apparatus; and a heat exchange system that exchanges heat between water for heat transfer to the refrigerant and the evaporator, thereby enhancing the heat exchange performance and efficiency of the evaporator.

14 Claims, 7 Drawing Sheets

DISH WASHER

CROSS-REFERENCE TO RELATED APPLICATION

Pursuant to 35 U.S.C. § 119(a), this application claims the benefit of an earlier filing date of and the right of priority to Korean Patent Application No. 10-2018-0148962, filed on Nov. 27, 2018, the contents of which is incorporated by reference herein in its entirety.

BACKGROUND

1. Technical Field

The present disclosure relates to a dish washer that heats washing water using a heat pump.

2. Description of the Related Art

A dish washer is a device that automatically washes and dries dishes using detergent or the like.

The dish washer may be configured to perform a process of washing, rinsing and drying dishes placed inside a main body thereof.

The dish washer may heat washing water using an electric heater provided in the main body.

However, the electric heater used in the dish washer has a problem that consumes a lot of power when washing and drying dishes.

In addition, high temperature washing water heated subsequent to the completion of washing is discharged to an outside of the dish washer, and thus there is a problem that energy loss occurs.

In order to solve the foregoing problems, a dish washer capable of reducing energy consumption by heating washing water using a heat pump and recovering waste heat from washing water discharged from the dish washer has been developed.

Prior art document EP 2 682 037 B1 (published on Jan. 8, 2014) discloses a dish washer and an operating method thereof. A dish washer in the prior art discloses a configuration in which outside air (hereinafter, ambient air) is sucked from an outside of the dish washer to an evaporator provided inside of a dish washer body to exchange heat between the outside air and the refrigerant of the evaporator so as to transfer heat from the outside air to the refrigerant.

However, according to the dish washer in the prior art, heat exchange may be carried out between the outside air and the refrigerant of the evaporator when the outside air passes through the evaporator, but there is a problem that the effects of energy saving and waste heat recovery in heating wash water is reduced due to low heat exchange performance and heat exchange efficiency.

In addition, washing water heating time may be prolonged due to a decrease in heat exchange performance, and an output of the compressor must be increased to reduce the washing water heating time, thereby increasing power consumption.

SUMMARY

The present disclosure has been made to solve the problems in the related art, an aspect of the present disclosure it to provide a dish washer capable of increasing the heat exchange performance and efficiency of the evaporator to shorten washing water heating time and reduce power consumption.

In order to achieve the foregoing objectives, a dish washer according to an example of the present disclosure may include a washing tank provided with a sump at a bottom surface thereof and provided with an accommodation space for storing dishes therein; a heat pump system provided with an evaporator, a compressor that compresses and circulates refrigerant, a condenser that heats washing water for washing the dishes, and an expansion apparatus; and a heat exchange system that exchanges heat between water for heat transfer to the refrigerant and the evaporator.

According to an example associated with the present disclosure, the heat exchange system may include a heat exchange chamber that stores the water therein, and accommodates the evaporator to exchange heat between the refrigerant and the water.

According to an example associated with the present disclosure, the dish washer may further include an injection arm disposed inside the washing tank, and provided with a plurality of nozzles for injecting the washing water onto the dishes; and a circulation pump that circulates the washing water collected in the sump into the injection arm.

According to an example associated with the present disclosure, the heat exchange system may include a flow generator mounted on the heat exchange chamber to generate a flow of water, and the flow generator may include an impeller that flows the water; and a drive motor that drives the impeller.

According to an example associated with the present disclosure, the heat exchange system may further include a water supply unit that supplies the water to the heat exchange chamber, and the heat exchange chamber may include an inlet port disposed at one side of the heat exchange chamber to allow the water flow in from the water supply unit; and an outlet port disposed at the other side of the heat exchange chamber to discharge the water from the heat exchange chamber.

According to an example associated with the present disclosure, the heat exchange system may further include a water pipe connected to the inlet port of the heat exchange chamber to supply the water; a water inlet valve provided at the water pipe to open and close the water pipe; an outlet pipe connected to the outlet port of the heat exchange chamber to discharge the water; and a water outlet valve provided at the outlet pipe to open and close the outlet pipe.

According to an example associated with the present disclosure, the evaporator may include a refrigerant pipe defined in a pipe shape to flow the refrigerant therein, and extended in a zigzag shape.

According to an example associated with the present disclosure, the heat exchange chamber may further include a plurality of guide members extending in a direction crossing the refrigerant pipe to allow the refrigerant pipe to pass therethrough a plurality of times so as to guide the straightness of the water.

According to an example associated with the present disclosure, the heat exchange chamber may include a heat transfer passage that defines a passage of the water, and the heat transfer passage may include a heat transfer portion that extends in a zigzag shape in a direction crossing the refrigerant pipe; an inlet passage portion that allows the water to flow into the heat transfer portion; and an outlet passage portion that allows the water to flow out of the heat transfer portion.

According to an example associated with the present disclosure, the dish washer may further include an electric heater that heats washing water to be flowed into the washing tank.

According to an example associated with the present disclosure, the condenser may be disposed in the sump to heat the washing water.

According to an example associated with the present disclosure, the dish washer may further include a preheating chamber provided with the condenser therein to preheat washing water to be flowed into the washing tank; an impeller rotatably mounted inside the preheating chamber to flow the washing water; and a drive motor that drives the impeller.

According to an example associated with the present disclosure, the dish washer may include a heat recovery chamber, one side of which is connected in communication with the sump, and the other side of which is connected in communication with a drain pipe for discharging the washing water, and mounted with the evaporator therein, to exchange heat between the washing water to be discharged to an outside of the dish washer and the evaporator so as to recover heat from the washing water.

According to an example associated with the present disclosure, the dish washer may further include an impeller rotatably mounted inside the heat recovery chamber to flow the washing water; and a drive motor that drives the impeller.

According to an example associated with the present disclosure, the dish washer may further include a controller that controls the flow generator.

A method of controlling a dish washer having the heat pump according to the present disclosure may include selecting an eco-mode for saving energy or a speed mode for shortening a washing time period; supplying washing water for washing dishes into a washing tank; exchanging heat between the washing water with the condenser to heat the washing water; exchanging heat between the evaporator accommodated in a heat exchange chamber and water stored in the heat exchange chamber to transfer heat to the refrigerant of the evaporator; and driving an impeller rotatably provided inside the heat exchange chamber to generate a flow in the water when the speed mode is selected and stop the operation of the impeller when the eco-mode is selected.

According to an example associated with a control method of a dish washer of the present disclosure, the dish washer may include pre-washing, main washing, rinsing, heating rinsing and drying strokes, and the impeller may be operated during the main washing or heating rinsing.

According to an example associated with a control method of a dish washer of the present disclosure, the method may further include heating the washing water using the condenser, and then measuring a temperature of the washing water; and further heating the washing water using an electric heater when the temperature of the washing water is lower than a preset temperature.

According to an example associated with a control method of a dish washer of the present disclosure, the method may further include supplying the heated washing water discharged from the washing tank to a heat recovery chamber; and exchanging heat between an evaporator accommodated in the heat recovery chamber and the washing water prior to being discharged to an outside of the dish washer to recover heat from the washing water.

According to an example associated with a control method of a dish washer of the present disclosure, said recovering the heat of the washing water may further include driving an impeller rotatably provided inside the heat recovery chamber to generate a flow in the washing water.

The effects of a dish washer having a heat pump according to the present disclosure will be described as follows.

First, an evaporator may be in contact with water for heat transfer to refrigerant to exchange heat, and a flow generator may generate a flow in the water, thereby promoting heat exchange between the water and the refrigerant in the evaporator.

Second, since an evaporation temperature of the refrigerant of the evaporator increases and a pressure of a compressor decreases by promoting heat exchange between the water and the evaporator, a washing water heating temperature of a condenser may increase by the same pressure of the compressor, thereby reducing washing water heating time.

Third, an evaporator and an impeller may be provided inside a heat exchange chamber, and a flow generator may rotate the impeller with a drive motor as a power source to flow water stored inside the heat exchange chamber to be mixed evenly, thereby allowing the water to uniformly transfer heat to the evaporator.

Fourth, a plurality of guide members may extend in a direction crossing a flow of refrigerant in the evaporator to guide the water to go straight while crossing a refrigerant pipe and uniformly distribute water to the zigzag-shaped refrigerant pipe, thereby efficiently performing heat exchange between the water and the refrigerant.

Fifth, a heat transfer passage may be disposed inside the heat exchange chamber, and the heat transfer passage may be disposed to extend in a zigzag shape in a direction crossing the refrigerant pipe of the evaporator, thereby promoting heat exchange.

Sixth, the heat transfer passage may include an inlet passage portion, a heat transfer portion, and an outlet passage portion, and water may deeply flow into an inner side of the heat exchange chamber along the inlet passage portion, and return from an inlet side of the heat transfer portion, and move to an upstream side of the inlet passage portion in a zigzag shape along the heat transfer portion and then return again from an outlet side of the heat transfer portion, and move to an outlet port along the outlet passage portion to be discharged, thereby extending heat exchange time between washing water to be discharged from a sump and the evaporator inside a heat recovery chamber so as to recover the maximum amount of heat.

Seventh, although a plurality of guide pins have been described as an example applied to the heat exchange chamber, the plurality of guide pins may also be applicable to a preheating chamber or the heat recovery chamber. However, the plurality of guide pins may be more advantageous in case of being applied to the heat exchange chamber and the preheating chamber in which heat exchange is carried out while water or washing water is filled in a predetermined amount due to a structural feature.

Eighth, the heat transfer passage has been described as an example applied to the heat exchange chamber, but may also be applicable to the preheating chamber or the heat recovery chamber. However, the heat transfer passage may be more advantageous when the heat transfer passage is applied to the heat recovery chamber in which heat exchange is continuously carried out with the inflow and outflow of water or washing water due to the nature of a passage structure.

DETAILED DESCRIPTION OF THE EMBODIMENTS

Figure 1:
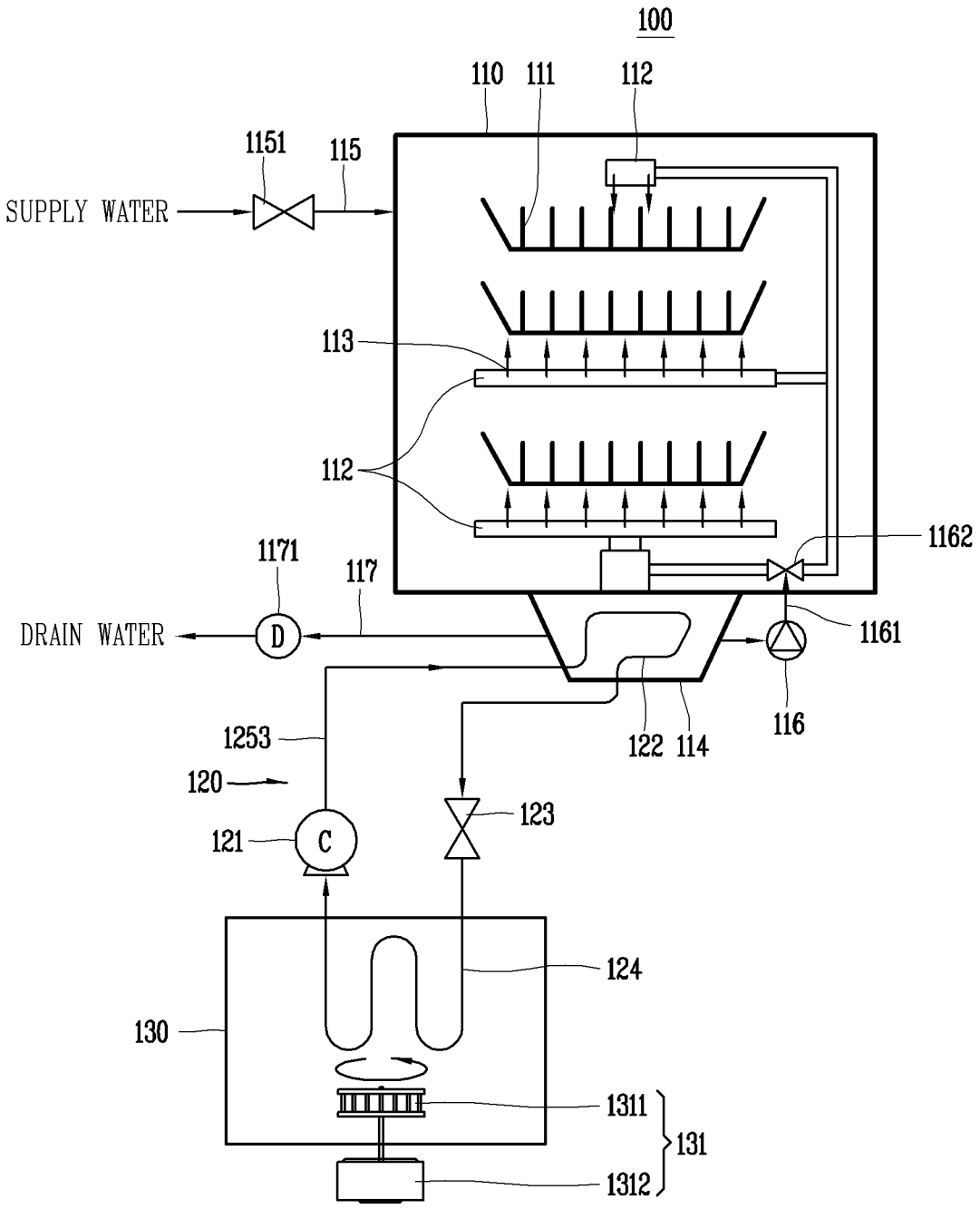
FIG. 1 is a conceptual view showing a state in which a flow generator is provided in a heat exchange chamber for increasing heat exchange performance of an evaporator in a dish washer having a heat pump according to a first embodiment of the present disclosure.

Hereinafter, the embodiments disclosed herein will be described in detail with reference to the accompanying drawings, and the same or similar elements are designated with the same numeral references regardless of the numerals in the drawings and their redundant description will be omitted. A suffix "module" and "unit" used for constituent elements disclosed in the following description is merely intended for easy description of the specification, and the suffix itself does not give any special meaning or function. In describing the embodiments disclosed herein, moreover, the detailed description will be omitted when specific description for publicly known technologies to which the invention pertains is judged to obscure the gist of the present disclosure. Also, it should be understood that the accompanying drawings are merely illustrated to easily explain the concept of the invention, and therefore, they should not be construed to limit the technological concept disclosed herein by the accompanying drawings, and the concept of the present disclosure should be construed as being extended to all modifications, equivalents, and substitutes included in the concept and technological scope of the invention.

It will be understood that, although the terms first, second, etc. may be used herein to describe various elements, these elements should not be limited by these terms. These terms are only used to distinguish one element from another.

It will be understood that when an element is referred to as being "connected with" another element, the element can be directly connected with the other element or intervening elements may also be present. On the contrary, in case where an element is "directly connected" or "directly linked" to another element, it should be understood that any other element is not existed therebetween.

A singular representation may include a plural representation as far as it represents a definitely different meaning from the context.

Terms "include" or "has" used herein should be understood that they are intended to indicate the existence of a feature, a number, a step, a constituent element, a component or a combination thereof disclosed in the specification, and it may also be understood that the existence or additional possibility of one or more other features, numbers, steps, constituent elements, components or combinations thereof are not excluded in advance.

Figure 2:
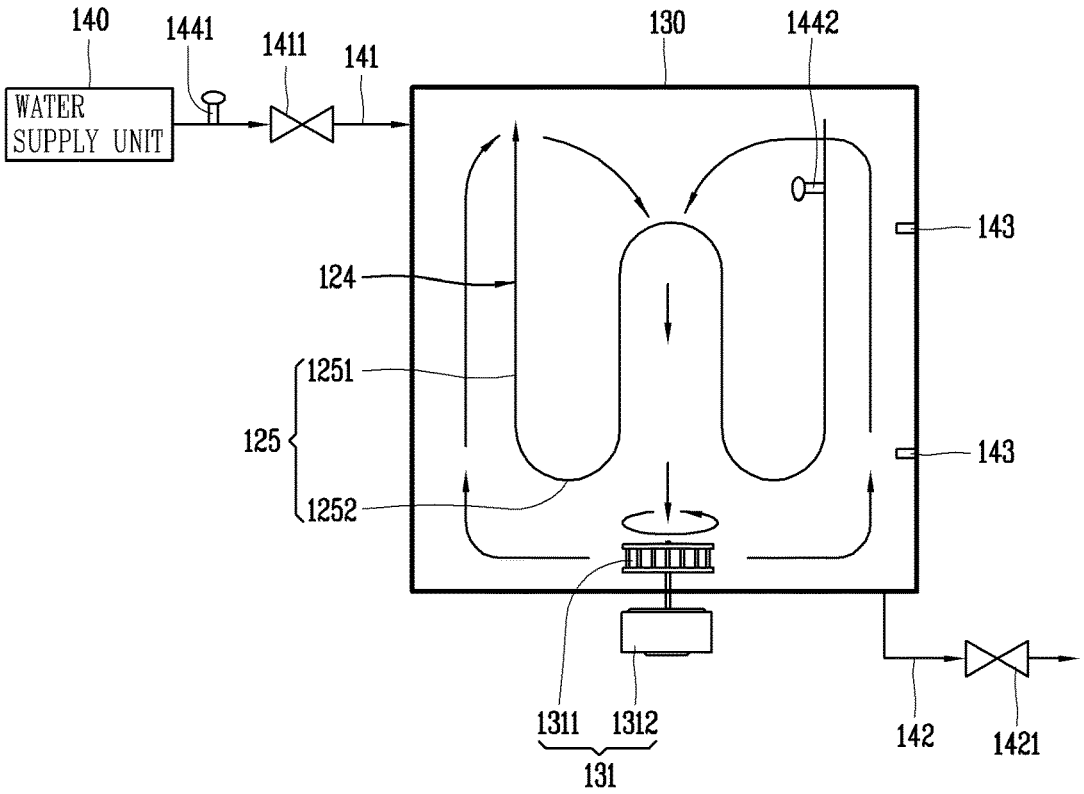
FIG. 2 is a conceptual view for explaining a heat exchange system that supplies water to the heat exchange chamber in FIG. 1.

FIG. 1 is a conceptual view showing a state in which a flow generator 131 is provided in a heat exchange chamber 130 for increasing heat exchange performance of an evaporator 124 in a dish washer 100 having a heat pump according to a first embodiment of the present disclosure, and FIG. 2 is a conceptual view for explaining the heat exchange system that supplies water to the heat exchange chamber 130 in FIG. 1.

The dish washer 100 may include a washing tank 110, a heat pump system 120, and a heat exchange system.

The washing tank 110 may include an accommodation space to accommodate and store dishes therein for washing the dishes. A plurality of racks 111 may be provided inside the washing tank 110 to store dishes.

The plurality of racks 111 may be spaced apart in a vertical direction. Each of the plurality of racks 111 may be provided with a plurality of holders to set up tableware such as plates, dishes or the like in an inclined manner. The plurality of holders may extend in a vertical direction and may be spaced apart in a transverse or longitudinal direction of the racks 111.

The washing tank 110 may be provided inside the cabinet. The cabinet (not shown) may define an appearance of the dish washer 100.

A dish inlet port may be disposed at a front side of the cabinet, and a door is rotatably mounted at the front side of the cabinet to open and close a dish inlet port. A front side of the washing tank 110 may be open to communicate with the dish inlet port of the cabinet.

According to this configuration, dishes may be put into the washing tank 110 through the dish inlet port, and stored in a shelf 111.

A plurality of injection arms 112 may be provided in the washing tank 110. The plurality of injection arms 112 may be disposed between the racks 111. The plurality of injection arms 112 may be spaced apart from one another in a vertical direction at upper, middle and lower portions of the accommodation space of the washing tank 110.

A plurality of nozzles 113 may be spaced apart in a length direction on each of the plurality of injection arms 112. Each of the plurality of injection arms 112 may have a passage configured to allow washing water to flow therein, and may distribute the washing water flowing in through the passage to the plurality of nozzles 113.

One side of the plurality of nozzles 113 is connected in communication with the passage of the injection arm 112 and the other side thereof is disposed to be open toward the rack 111 so as to inject washing water distributed from the injection arm 112 to dishes through the nozzles 113.

A sump 114 is disposed to be recessed downward on a bottom surface of the washing tank 110 to collect washing water in the sump 114 subsequent to washing dishes.

Washing water may be supplied into the washing tank 110 from an outside of the washing tank 110, that is, from a water supply portion. The water supply portion may be, for example, a tap and a water pipe for supplying tap water.

The washing tank 110 may be connected to the water supply portion through a water pipe 115. One side of the water pipe 115 may be connected to the water supply portion, and the other side of the water pipe 115 may be connected to the washing tank 110 to supply washing water into the washing tank 110 from the water supply portion.

A water inlet valve 1151 may be provided in the water pipe 115 to open and close the water pipe 115. The water pipe 115 may be connected to the sump 114 of the washing tank 110 to supply washing water to the sump 114.

A detergent dispensing unit may be provided at one side of the cabinet. The detergent dispensing unit may be configured to store detergent. A detergent connection pipe 1252 may be connected between the detergent dispensing unit and the sump 114 to move detergent dispensed from the detergent dispensing unit to the sump 114 along the detergent connection pipe 1252.

A circulation pump 116 may be provided inside the cabinet. The circulation pump 116 is configured to mix washing water and detergent collected in the sump 114 to circulate the mixed washing water and detergent to the plurality of injection arms 112.

The plurality of injection arms 112 and the circulation pump 116 may be connected by a circulation pipe 1161. One side of the circulation pipe 1161 may be connected in communication with one side of the sump 114, and the other side of the circulation pipe 1161 may be arranged in a plurality of branches from one side of the circulation pipe 1161 and connected in communication with each of the plurality of injection arms 112.

A direction switching valve 1162 may be provided at a point branched from the other side of the circulation pipe 1161, and the direction switching valve 1162 may distribute washing water or the like to each of the plurality of injection arms 112 from the branch point.

According to this configuration, washing water and detergent may be transferred to the injection arms 112 from the sump 114 along the circulation pipe 1161 by the circulation pump 116.

A drain pipe 117 may be connected to the sump 114. One side of the drain pipe 117 may be connected in communication with the other side of the sump 114, and the other side of the drain pipe 117 may be connected in communication with an outside of the dish washer 100 to discharge washing water that has completed dish washing to the outside from the sump 114 through the drain pipe 117.

A drain pump 1171 may be provided at the drain pipe 117, and the drain pump 1117 may suck washing water collected in the sump 114 into the drain pipe 117 and discharge the sucked washing water to the outside.

A heat pump system 120 may be provided in the cabinet.

The heat pump system 120 may include a compressor 121, a condenser 122, an expansion apparatus 123, and an evaporator 124. The compressor 121, the condenser 122, the expansion apparatus 123, and the evaporator 124 may be connected to one another by a refrigerant circulation passage 1253 to define a refrigerant circuit.

The refrigerant circulation passage 1253 may be configured as a refrigerant circulation pipe to allow refrigerant to flow therein.

The compressor 121 is configured to compress refrigerant to circulate the refrigerant along the refrigerant circulation passage 1253. An inverter is mounted to the compressor 121, and the inverter may drive the compressor 121. For example, the inverter may be configured to adjust the RPM of a motor provided inside the compressor 121 to control a discharge amount of refrigerant compressed in the compressor 121. According to this, the output of the compressor 121 may be adjusted.

The condenser 122 may be disposed in sump 114. The condenser 122 may exchange heat between high-temperature, high-pressure gas refrigerant compressed from the compressor 121 and washing water to condense the refrigerant.

Liquid refrigerant condensed in the condenser 122 may transfer latent heat of condensation to washing water, thereby heating the washing water.

The expansion apparatus 123 may be configured as a capillary tube or an expansion valve. The expansion apparatus 123 may expand refrigerant condensed in the condenser 122 into low-temperature, low-pressure refrigerant. The expansion valve may be configured to adjust an amount of the low-temperature, low-pressure refrigerant to be supplied to the evaporator 124 according to a control signal of the controller 170.

The evaporator 124 may be configured to evaporate the refrigerant expanded in the expansion apparatus 123 into gas refrigerant.

The evaporator 124 may be accommodated inside the heat exchange chamber 130.

The heat exchange chamber 130 may be provided inside the cabinet separately from the washing tank 110.

Heat transfer water may be stored in the heat exchange chamber 130. The heat transfer water is configured to transfer heat to refrigerant. The heat transfer water is different from washing water for washing dishes in that it is a fluid for performing a heat transfer function of transferring heat to the refrigerant of the evaporator 124.

The evaporator 124 may be configured as a refrigerant pipe 125 in a circular pipe shape to allow refrigerant to flow therein. The condenser 122 may be configured as a refrigerant pipe 125 in a circular pipe shape to allow refrigerant to flow therein.

The refrigerant pipe 125 of each of the evaporator 124 and the condenser 122 may be bent in a zigzag shape.

The evaporator 124 may be provided to be immersed in water in the heat exchange chamber 130.

According to this configuration, the heat exchange chamber 130 may exchange heat between water stored therein and refrigerant in the evaporator 124 to transfer heat from the water to the refrigerant. Tap water or the like may be used as water of the heat transfer fluid.

The flow generator 131 may be provided inside the heat exchange chamber 130.

The flow generator 131 may include an impeller 1311 and a drive motor 1312. An impeller 1311 is rotatably mounted to agitate water stored in the heat exchange chamber 130.

The impeller 1311 may be connected to the drive motor 1312 through a rotary shaft. One side of the rotary shaft may be connected to the impeller 1311, and the other side of the rotary shaft may be connected to the drive motor 1312. The drive motor 1312 may be mounted inside or outside the heat exchange chamber 130.

According to this configuration, the flow generator 131 may rotate the impeller 1311 by the power of the drive motor 1312 to flow water in the heat exchange chamber 130, thereby promoting heat exchange between water and refrigerant, and improving heat exchange performance and heat exchange efficiency.

The heat exchange system is configured to exchange heat between water, which is a heat transfer fluid, and the evaporator 124.

The heat exchange system may include a heat exchange chamber 130, a water supply unit 140, a water pipe 141, a water inlet valve 1151, an outlet pipe 142, and a water outlet valve 1421.

The water supply unit 140 may be configured to supply water such as tap water. The water supply unit 140 may be tap water.

One side of the water pipe 141 may be connected to the water supply unit 140, and the other side thereof may be connected to the heat exchange chamber 130 to connect the water supply unit 140 and the heat exchange chamber 130. An inlet port 1301 may be disposed at one side of the heat exchange chamber 130, and the inlet port 1301 may be connected to the water pipe 141 to allow water to flow into the heat exchange chamber 130.

A water inlet valve 1411 may be provided in the water pipe 141 to selectively open and close the water pipe 141.

An outlet port 1302 may be provided inside the heat exchange chamber 130. One side of the outlet pipe 142 may be connected to the outlet port 1302 of the heat exchange chamber 130, and the other side thereof may be connected in communication with an outside of the dish washer 100.

A water outlet valve 1421 may be provided in the outlet pipe 142 to selectively open and close the outlet pipe 142.

A water level sensor 143 may be provided inside the heat exchange chamber 130 to sense a water level of the heat exchange chamber 130.

A first temperature sensor 1441 may be provided in the water pipe 141 to sense a temperature of water supplied to the water supply unit 140.

A second temperature sensor 1442 may be provided at an inlet of the evaporator 124 to sense a temperature of refrigerant flowing into the evaporator 124.

The controller 170 may receive a sensing signal from the water level sensor 143 to control the water inlet valve 1411 and the water outlet valve 1421. For example, when a water level inside the heat exchange chamber 130 is less than or equal to a preset value, the water inlet valve 1411 may be opened and the water outlet valve 1421 may be closed to fill the heat exchange chamber 130 with water. During maintenance, the water outlet valve 1421 may be opened to drain water stored in the heat exchange chamber 130.

The controller 170 may receive sensing signals from the first temperature sensor 1442 and the second temperature sensor 1442 to compare the water temperature with the refrigerant temperature of the evaporator 124, and when the water temperature is higher than the refrigerant temperature of the evaporator 124, the controller 170 may open the water inlet valve 1411 to exchange heat between the water and the refrigerant of the evaporator 124 inside the heat exchange chamber 130.

When the water temperature is lower than the refrigerant temperature of the evaporator 124, the water outlet valve 1421 may be opened to discharge water from the heat exchange chamber 130, thereby exchanging heat between the air of the heat exchange chamber 130 and the refrigerant of the evaporator 124. To this end, a plurality of vent holes may be arranged at an upper end portion of the heat exchange chamber 130.

Figure 3:
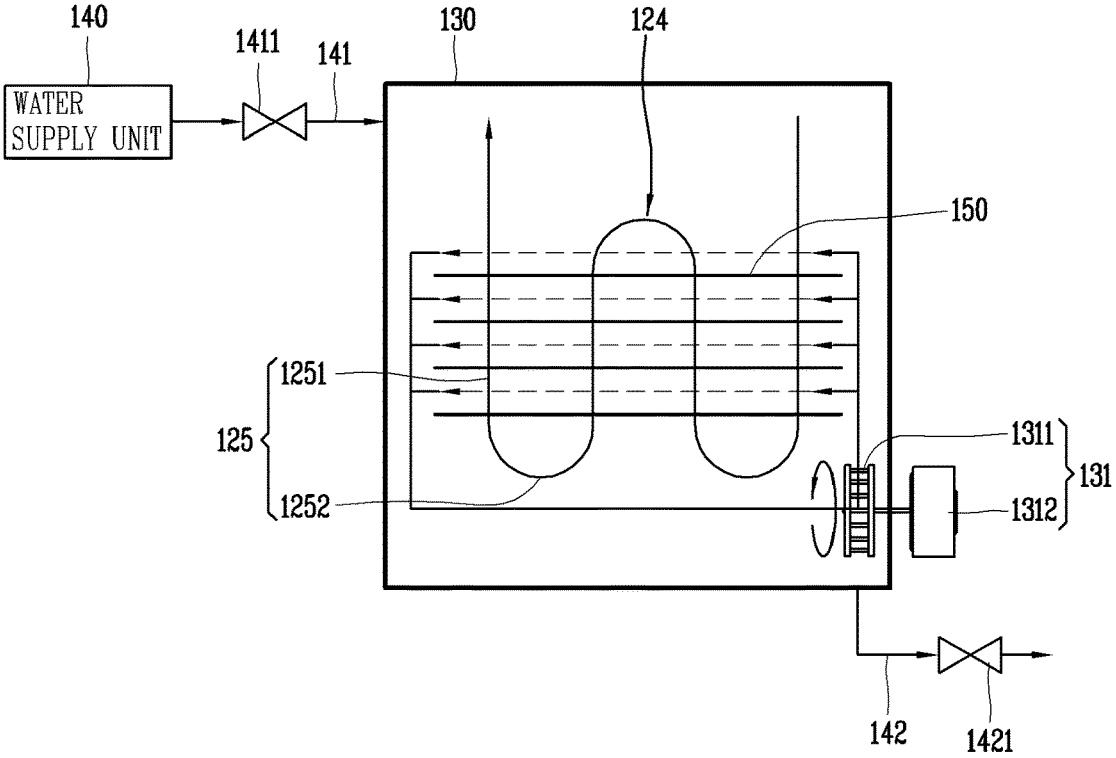
FIG. 3 is a conceptual view showing a state in which the heat exchange chamber having a guide member in FIG. 2 is viewed from above.

FIG. 3 is a conceptual view showing a state in which the heat exchange chamber 130 having a guide member 150 in FIG. 2 is viewed from above.

The heat exchange chamber 130 may be defined in a rectangular shape.

A refrigerant pipe 125 of the evaporator 124 may include a plurality of straight pipes 1251 and a plurality of connection pipes 1252. Each of the plurality of straight pipes 1251 may extend in a longitudinal direction of the heat exchange chamber 130. Each of the plurality of straight pipes 1251 may be spaced apart in a transverse direction of the heat exchange chamber 130.

Each of the plurality of connection pipes 1252 may be defined in a semicircular curved shape. Each of the plurality of connection pipes 1252 may be configured to connect two straight pipes 1251 adjacent to each other in the transverse direction. One end of the connection pipe 1252 may be connected to one end of either one of the two straight pipes 1251 adjacent to each other in the transverse direction, and the other end of the connection pipe 1252 may be connected to one end of the other one of the two straight pipes 1251.

The plurality of connection pipes 1252 and the plurality of straight pipes 1251 may be alternately arranged in a transverse direction, and the plurality of connecting pipes 1252 may be alternately arranged in a zigzag shape in a longitudinal direction.

A plurality of guide members 150 may be provided inside the heat exchange chamber 130.

The plurality of guide members 150 may be configured in a flat plate shape.

The refrigerant pipe 125 may extend in a zigzag shape to pass through each of the plurality of guide members 150 a plurality of times.

Each of the plurality of guide members 150 may extend in a direction crossing the refrigerant pipe 125, for example, in a transverse direction. Each of the plurality of guide members 150 may be spaced apart in a longitudinal direction of the heat exchange chamber 130.

Each of the plurality of guide members 150 may be made of a metal material such as aluminum.

According to this configuration, the flow generator 131 may suck water inside the heat exchange chamber 130 from the front side of the impeller 1311 to the rear side to circulate the water in one direction.

In addition, the guide member 150 may guide a flow direction of water from one side to the other side in the transverse direction crossing the refrigerant pipe 125, thereby allowing the water and the refrigerant pipe 125 to cross each other vertically.

In addition, water circulated by the power of the flow generator 131 may flow in between end portions at one side in a length direction of the plurality of guide members 150, and move along the plurality of guide members 150 to be evenly distributed to the refrigerant pipe 125 of the evaporator 124 defined in a zigzag shape in a longitudinal direction to uniformly carry out heat exchange between the water and the refrigerant of the evaporator 124, thereby further improving the heat exchange performance and efficiency of the evaporator 124.

In addition, when the guide member 150 is made of a metal material such as aluminum, a heat exchange area between the water and the refrigerant pipe 125 may be extended by the guide member 150, thereby enhancing the heat exchange performance of the evaporator 124.

A plurality of through holes in each of the plurality of guide members 150, such that water may move between two guide members 150 adjacent in the longitudinal direction through the through holes.

According to this configuration, water may pass between two guide members 150 adjacent to each other through the through holes to uniformly exchange heat between the water and the refrigerant.

Figure 4:
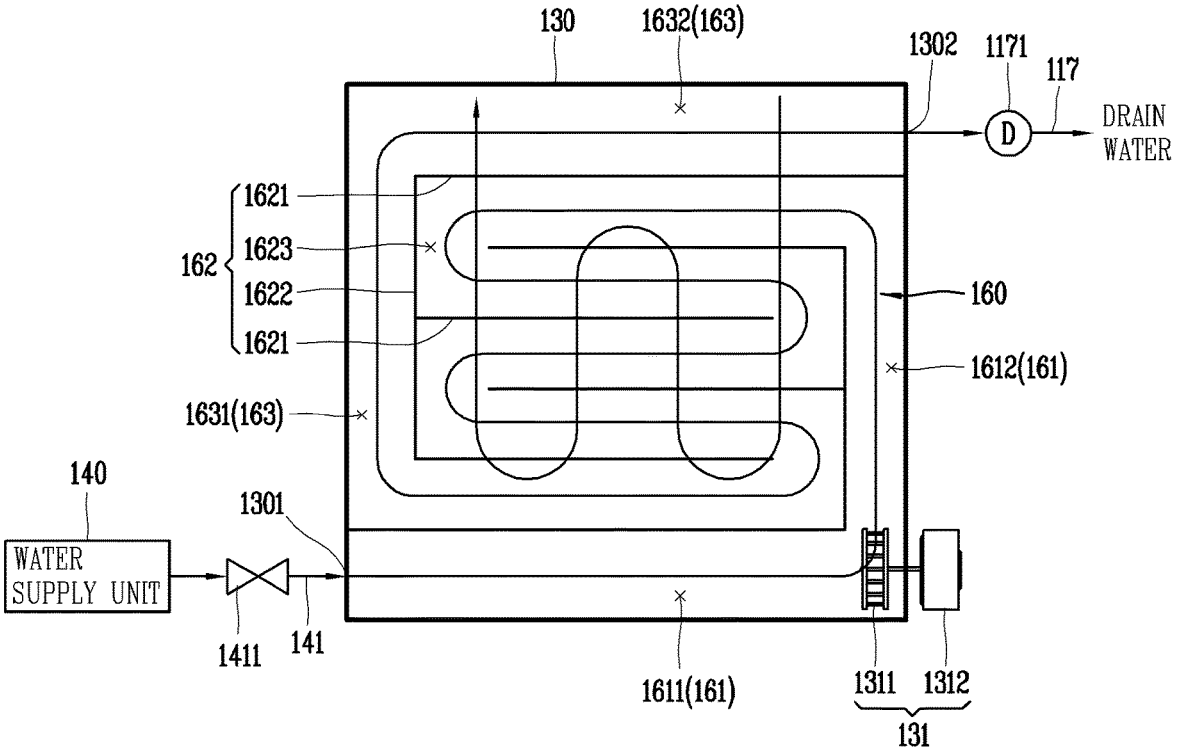
FIG. 4 is a conceptual view showing a state in which a heat exchange passage is disposed in the heat exchange chamber in FIG. 2.

FIG. 4 is a conceptual view showing a state in which a heat transfer passage 160 is disposed inside the heat exchange chamber 130 in FIG. 2.

The inlet port 1301 and the outlet port 1302 of the heat exchange chamber 130 may be spaced apart from each other in a diagonal direction.

The heat transfer passage 160 may be disposed inside the heat exchange chamber 130.

The heat transfer passage 160 may include an inlet passage portion 161, an outlet passage portion 163, and a heat transfer portion 162.

One side of the inlet passage portion 161 may be connected in communication with the inlet port 1301 of the heat exchange chamber 130, and the other side thereof is connected in communication with an inlet side of the heat transfer portion 162 to guide water to the heat transfer portion 162.

The inlet passage portion 161 may include a first inlet passage portion 1611 extending in a transverse direction from the inlet port 1301 and a second inlet passage portion 1612 extending in a longitudinal direction from a right end of the first inlet passage portion 1611 to the inlet port 1301 of the heat transfer portion 162.

One side of the outlet passage portion 163 may be connected in communication with the outlet port 1302 of the heat exchange chamber 130, and the other side thereof may be connected in communication with an outlet side of the heat transfer portion 162 to discharge water from the heat transfer portion 162 through the outlet port 1302.

The outlet passage portion 163 may include a first outlet passage portion 1631 extending in a longitudinal direction from an outlet side of the heat transfer portion 162 and a second outlet passage portion 1632 extending in a transverse direction toward the outlet port 1302 from the first outlet passage portion 1631.

The heat transfer portion 162 may be defined in a zigzag shape in a direction crossing the refrigerant pipe 125 of the evaporator 124.

The heat transfer portion 162 may include a plurality of partition walls 1621, 1622 and a communication hole 1623.

For example, the plurality of partition walls 1621, 1622 may include a plurality of first partition walls 1621 and a plurality of second partition walls 1622.

Each of the plurality of first partition walls 1621 may extend in a transverse direction and be spaced apart in a longitudinal direction.

Each of the plurality of second partition walls 1622 may extend in s longitudinal direction to connect an end portion of each of the plurality of first partitions 1621.

The communication hole 1623 may be disposed at one end portion or the other end portion of each of the plurality of first partition walls 1621. Each of the plurality of communication holes 1623 may be spaced apart in a zigzag shape in a longitudinal direction to communicate between two first partition walls 1621 adjacent to each other in the longitudinal direction and to flow a flow direction of water in a zigzag shape.

An inlet side of the heat transfer portion 162 may be disposed adjacent to the outlet port 1302 of the heat exchange chamber 130, and an outlet side of the heat transfer portion 162 may be disposed adjacent to the inlet port 1301 of the heat exchange chamber 130.

Looking at the movement path of water, water may flow into the heat exchange chamber 130 through the inlet port 1301, and move in transverse and longitudinal directions toward the outlet port 1302 along the inlet passage portion 161, and return toward the inlet port 1301 from the inlet side of the heat transfer portion 162 and move in a zigzag shape along the heat transfer portion 162.

Subsequently, water may return from the outlet side of the heat transfer portion 162 back toward the outlet port 1302, and move in longitudinal and transverse directions along the outlet passage portion 163, and flow out to an outside of the heat exchange chamber 130 through the outlet port 1302.

According to this configuration, water may deeply flow inward toward the outlet port 1302 of the heat exchange chamber 130 along the inlet passage portion 161 by the power of the flow generator 131, and then move in a zigzag shape toward the inlet port 1301 along the heat transfer portion 162, and then flow back outward toward the outlet port 1302 to extend a time capable of exchanging heat between water flowing into the heat exchange chamber 130 and the evaporator 124, thereby improving heat exchange performance and heat exchange efficiency.

Figure 5:
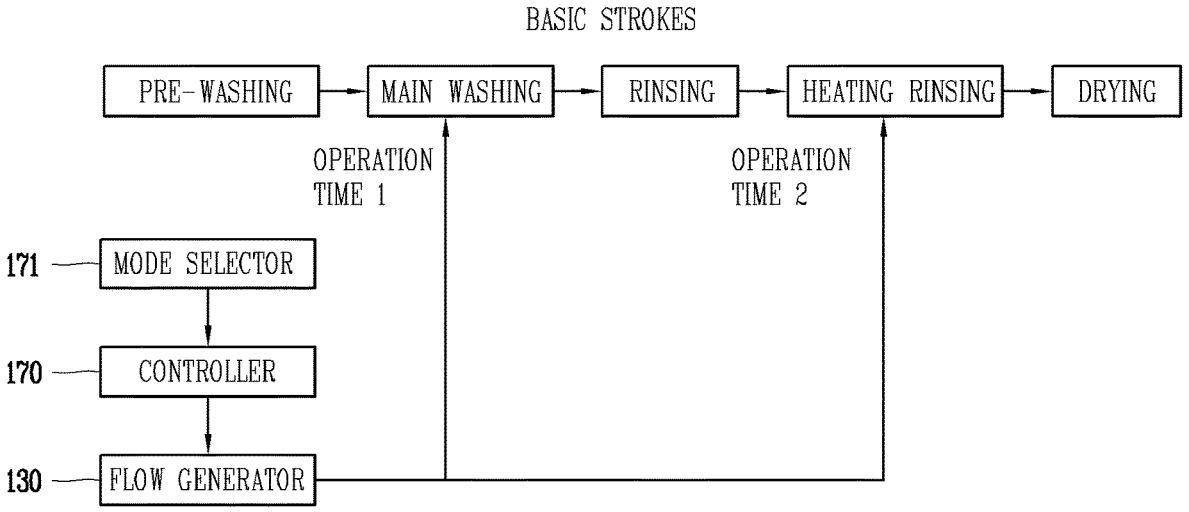
FIG. 5 is a conceptual view showing an operation time of a flow generator during a basic stroke of a dish washer according to the present disclosure.
Figure 6:
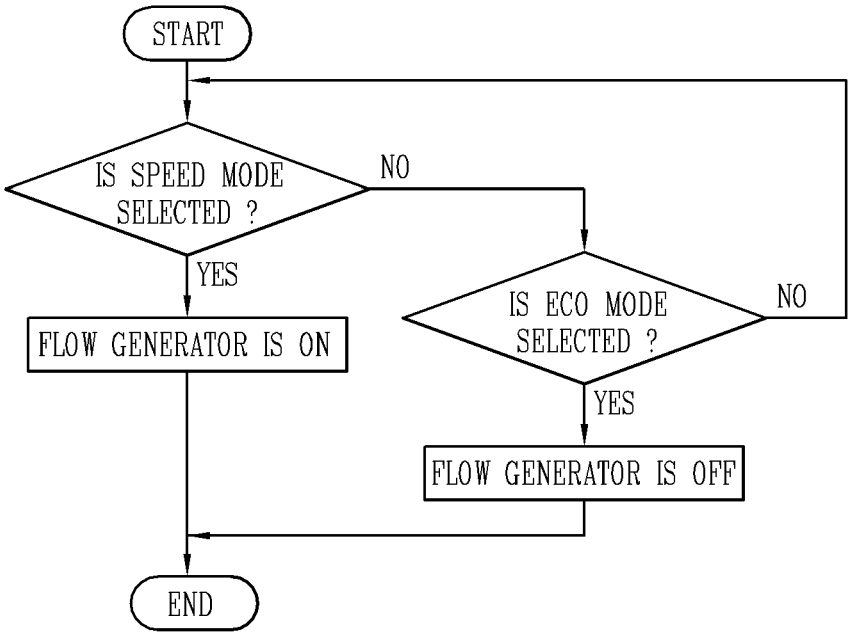
FIG. 6 is a conceptual view for explaining a method of operating a flow generator in an eco-mode and a speed mode of the dish washer according to the present disclosure.

FIG. 5 is a conceptual view showing an operation time of the flow generator 131 during a basic stroke of the dish washer 100 according to the present disclosure, and FIG. 6 is a conceptual view for explaining a method of operating the flow generator 131 in an eco-mode and a speed mode of the dish washer 100 according to the present disclosure.

Basic stroke of the dish washer 100 according to the present disclosure may be carried out in the order of pre-washing, main washing, rinsing, heating rinsing and drying strokes.

Pre-washing denotes injecting washing water without detergent to remove large contaminants on dishes, for example, food leftovers, or the like, and the main washing denotes injecting washing water containing detergent to completely remove contaminants.

Rinsing is to inject washing water so as to remove detergent or the like from dishes, and heating rinsing denotes removing germs or the like that can be sterilized at high temperatures in accordance with the temperature of washing water.

Drying denotes injecting hot air to dry washing water or the like from dishes.

The controller 170 may control the flow generator 131 to operate (ON) the flow generator 131 together with the heat pump system 120 during main cleaning or heating rinsing. The controller 170 may turn off the flow generator 131 during pre-washing or rinsing.

A UI (user interface) module may be mounted on a door of the cabinet.

The UI module may include a user control panel and a display such as a touch panel or a keypad.

The user control panel may include a mode selector 171. The mode selector 171 may include a speed mode and an eco-mode. The speed mode refers to a mode that shortens washing time even though power consumption is increased, and the eco-mode refers to a mode that reduces power consumption even though washing time is extended.

The user may select a speed mode or an eco-mode through the mode selector 171.

The controller 170 may determine whether to operate the heat pump system 120 and the flow generator 131 according to the speed mode or the eco-mode.

For example, when the user selects the speed mode, the controller 170 may shorten the heating time of washing water by operating the heat pump system 120 and the flow generator 131.

When the user selects the eco-mode, the controller 170 may operate the heat pump system 120 but stop the operation of the flow generator 131, thereby reducing power consumption.

Figure 7:
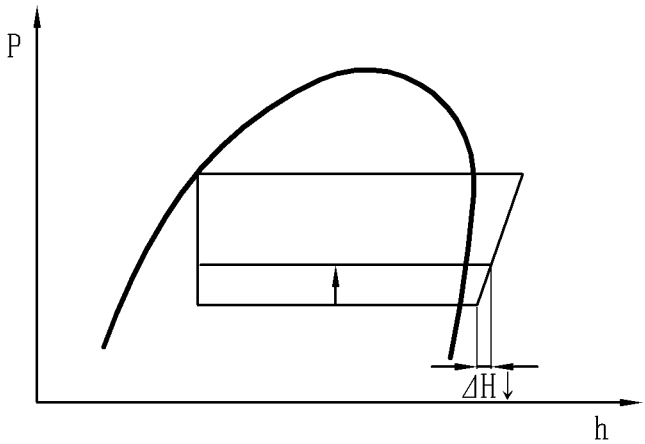
FIG. 7 is a conceptual view showing a PH diagram for explaining the effect when a flow generator according to the present disclosure is applied.

FIG. 7 is a conceptual view showing a PH diagram for explaining the effect when the flow generator 131 according to the present disclosure is applied.

Referring to FIG. 7, the flow generator 131 may promote heat exchange between the refrigerant of the evaporator 124 and water to increase the evaporation temperature and the evaporation pressure of the refrigerant of the evaporator 124.

In addition, the heating temperature of the condenser 122 may be increased by increasing the heat exchange efficiency of the evaporator 124 by the flow generator 131.

In addition, the washing water heating time may be reduced as the heating temperature of the condenser 122 increases with the same pressure of the compressor 121.

Figure 8:
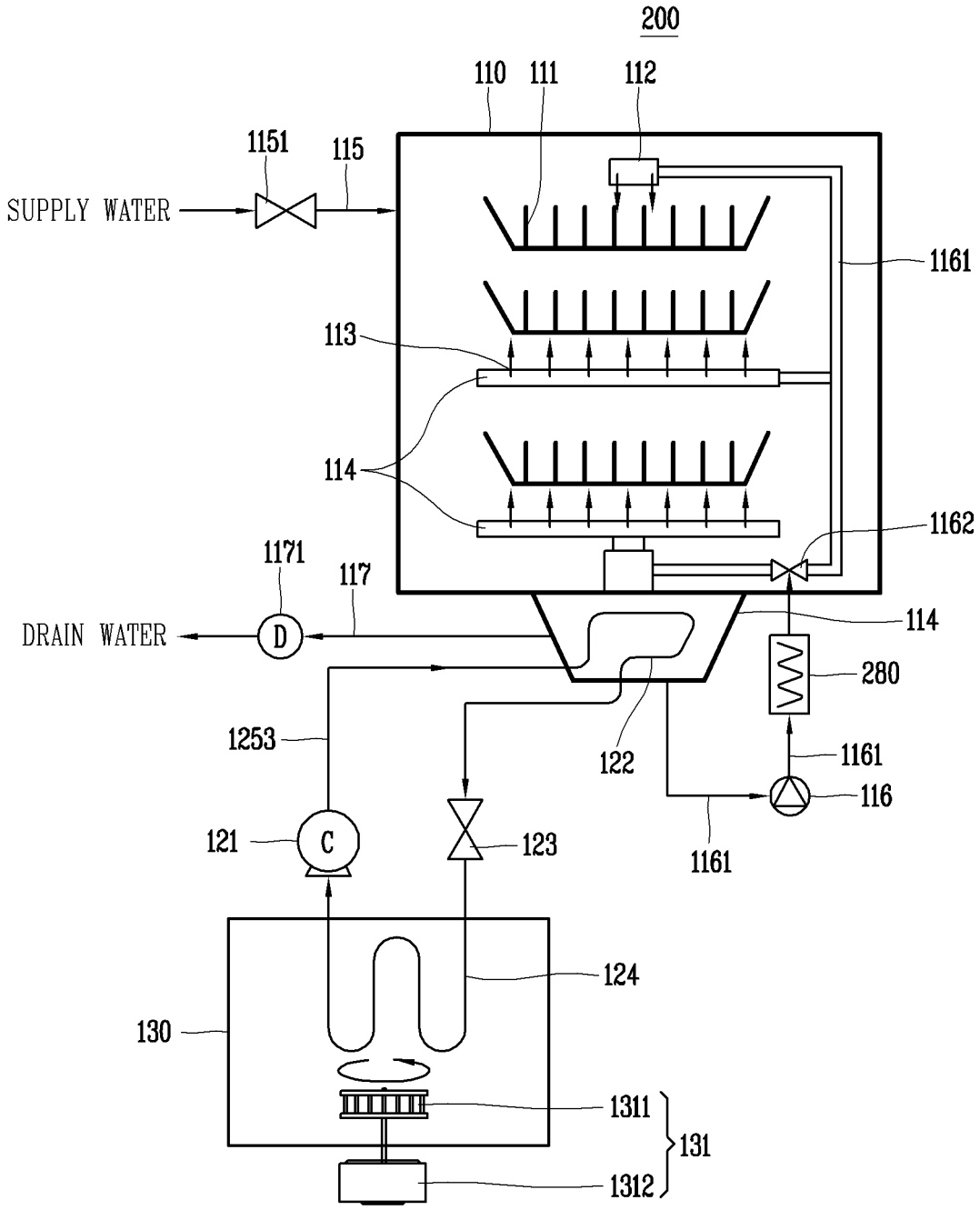
FIG. 8 is a conceptual view showing an example in which a flow generator is applied to a hybrid dish washer using an electric heater and a heat pump as a heating source according to a second embodiment of the present disclosure.

FIG. 8 is a conceptual view showing an example in which the flow generator 131 is applied to a hybrid dish washer 200 using an electric heater 280 and a heat pump as a heating source according to a second embodiment of the present disclosure.

The present embodiment is different from the first embodiment in that the electric heater 280 is added to the dish washer 200. Since other components are the same as or similar to those of the first embodiment, their duplicated descriptions will be omitted.

The electric heater 280 is provided with an electric coil therein to heat washing water by heating the electric coil when power is applied to the electric coil.

The electric heater 280 may be disposed at a downstream side of the circulation pump 116. The electric heater 280 may be disposed at the circulation pipe 1161 extending from the circulation pump 116 to the injection arm 112.

According to this configuration, washing water may be primarily heated by the condenser 122 in the sump 114, and then secondarily heated by the electric heater 280. For example, when the heating temperature of washing water discharged from the sump 114 is measured to compare the measured washing water temperature with a preset temperature, it is necessary to further heat the washing water when the washing water temperature is lower than the preset temperature value. In this case, the washing water may be secondarily heated by applying power to the electric heater 280.

When the washing water is heated, the heat pump system 120 is always used as a main heating source, and the electric heater 280 may be selectively turned on or off according to the basic stroke.

In addition, the electric heater 280 may be selectively used according to the eco-mode and the speed mode.

For example, only the heat pump system 120 may be operated in the eco-mode, and both the heat pump system 120 and the electric heater 280 may be operated together in the speed mode.

Figure 9:
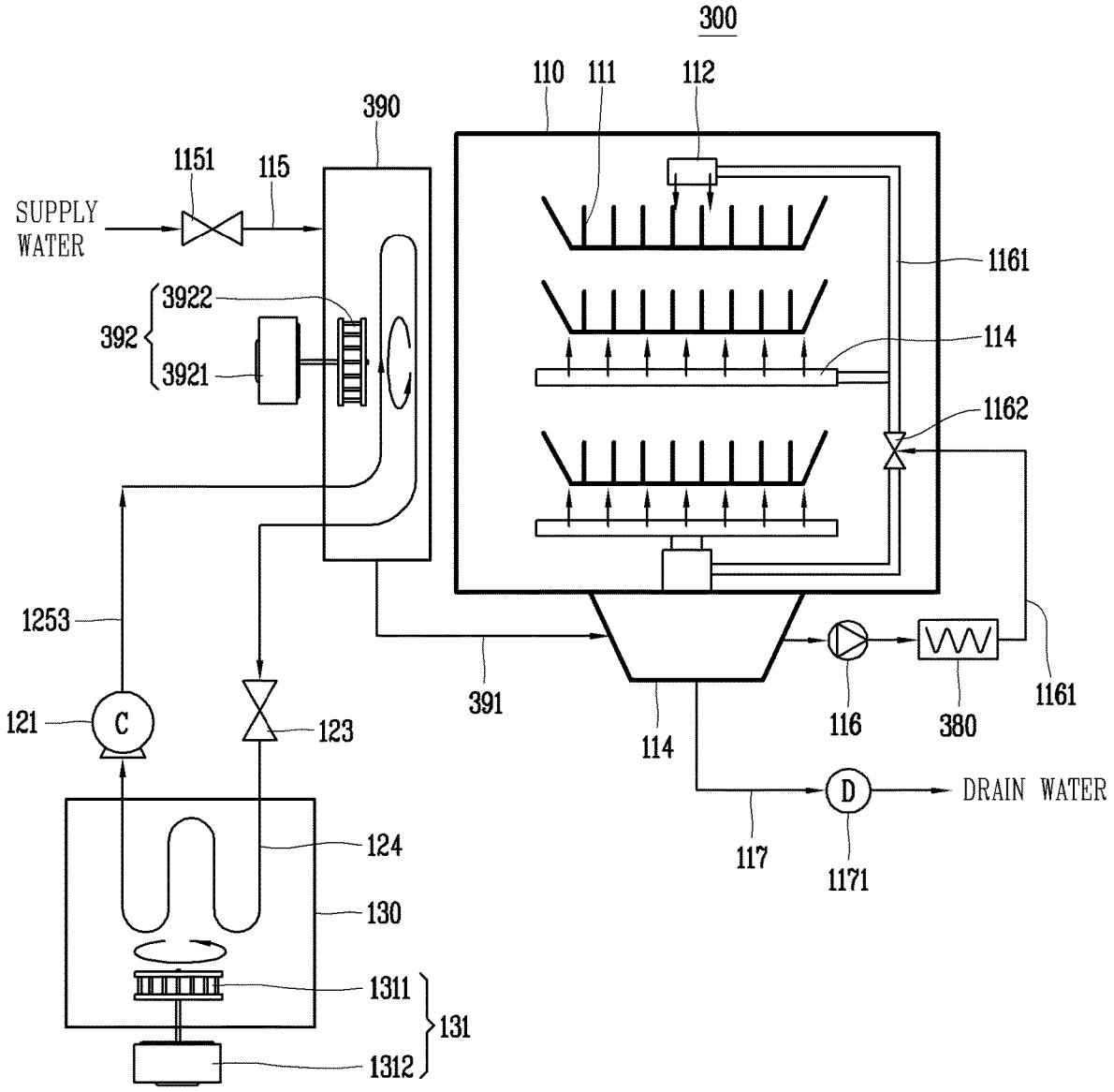
FIG. 9 is a conceptual view showing a state in which a flow generator is provided in a heat exchange chamber and a preheating chamber, respectively, to increase heat exchange performance of an evaporator and a condenser in a dish washer according to a third embodiment of the present disclosure.

FIG. 9 is a conceptual view showing a state in which a flow generator is provided in the heat exchange chamber 130 and a preheating chamber 390, respectively, to increase heat exchange performance of the evaporator 124 and a condenser 322 in a dish washer 300 according to a third embodiment of the present disclosure.

The present embodiment is different from the first embodiment in that a preheating chamber 390 that preheats washing water prior to supplying washing water to the washing tank 110. Since other components are the same as or similar to those of the first embodiment, their duplicated descriptions will be omitted and descriptions will be given based on differences.

Since the present embodiment is the same as or similar to the second embodiment in that the electric heater 280 is disposed at a downstream side of the circulation pump 116, the description of the electric heater 280 will be replaced with the second embodiment.

The preheating chamber 390 may be disposed inside or outside the washing tank 110. The preheating chamber 390 may be disposed at one side of the washing tank 110 when provided outside the washing tank 110.

The preheating chamber 390 and the washing tank 110 may be connected by a preheating water pipe 391. One side of the preheating water pipe 391 may be connected in communication with a lower end portion of the preheating chamber 390, and the other side of the preheating water pipe 391 may be connected to the sump 114 of the preheating chamber 390.

The condenser 322 may be accommodated in the preheating chamber 390 without being provided in the sump 114.

Washing water may be supplied to the preheating chamber 390 to be temporarily stored. Washing water may be preheated by the condenser 322 accommodated in the preheating chamber 390.

Inside the preheating chamber 390, the washing water and the refrigerant of the condenser 322 may exchange heat with each other to heat the washing water.

According to this configuration, washing water may be supplied to the preheating chamber 390 during pre-washing prior to entering main washing, and preheated through the condenser 322, thereby reducing the heating time of the washing water during the main washing.

The flow generator 392 may be provided inside the preheating chamber 390, and the impeller 1311 may generates a flow in washing water, thereby improving heat exchange efficiency between the washing water and the refrigerant.

Figure 10:
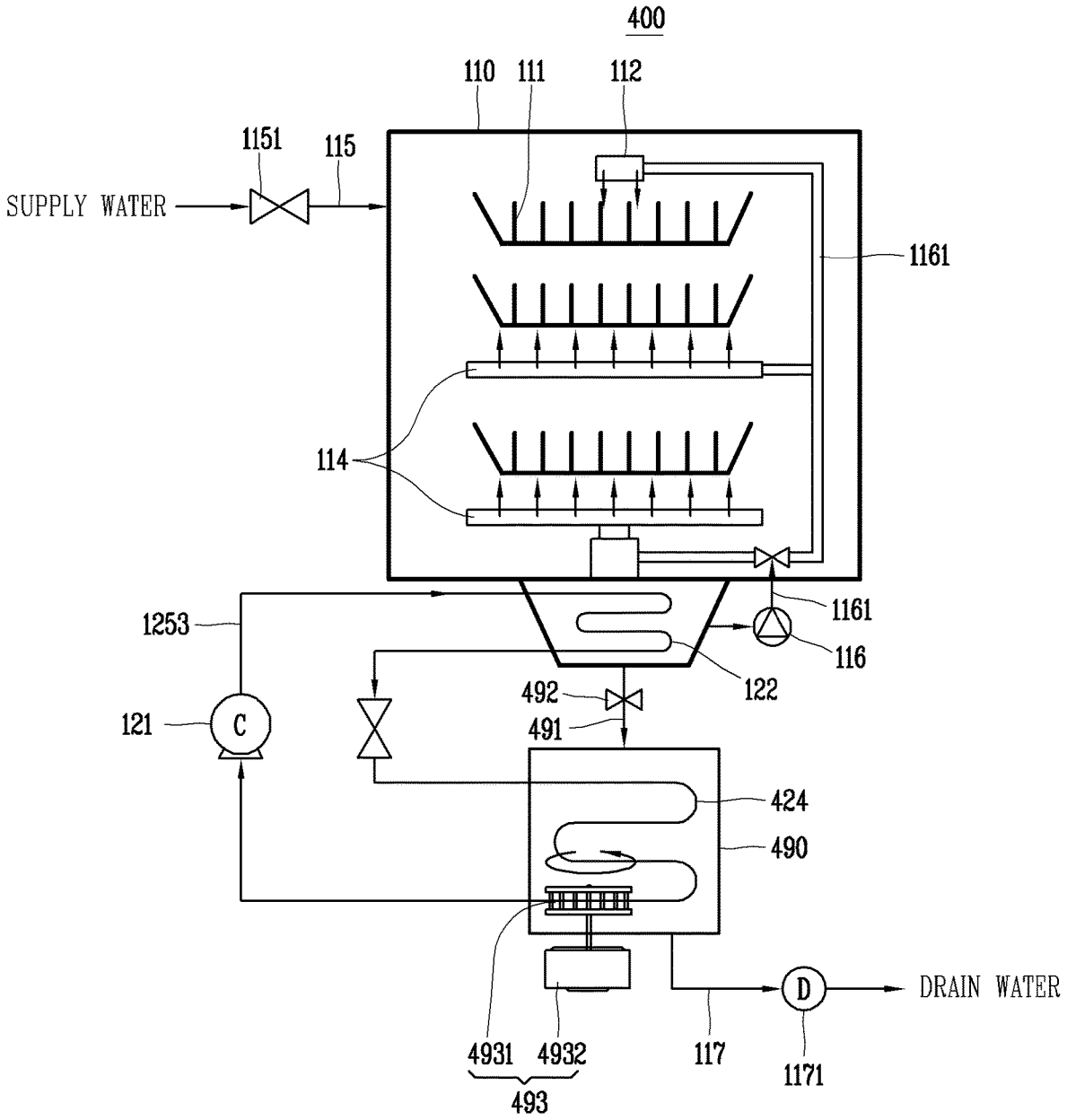
FIG. 10 is a conceptual view showing a state in which a flow generator is provided in a heat recovery chamber to increase heat exchange performance of an evaporator in a dish washer according to a fourth embodiment of the present disclosure.

FIG. 10 is a conceptual view showing a state in which a flow generator 493 is provided in a heat recovery chamber 490 to increase heat exchange performance of an evaporator 424 in a dish washer 400 according to a fourth embodiment of the present disclosure.

The dish washer 400 of the present embodiment is different from the first embodiment in that the dish washer 400 includes a heat recovery chamber 490 for recovering waste heat from washing water to be discharged from the sump 114. Since other components are the same as or similar to those of the first embodiment, their duplicated descriptions will be omitted.

The heat recovery chamber 490 is configured to temporarily store washing water prior to discharging the washing water from the sump 114 and then recover heat from the heated washing water. Heat recovery connection pipes 491, 1252 may be connected between the sump 114 and the heat recovery chamber 490 to transfer washing water from the sump 114 along the heat recovery connection pipes 491, 1252 to the heat recovery chamber 490.

A heat recovery valve 492 may be provided in the heat recovery connection pipes 491, 1252 to open and close the heat recovery connection pipes 491, 1252.

The evaporator 424 may be provided in the heat exchange chamber 490. The evaporator 424 may be immersed to exchange heat with washing water stored in the heat recovery chamber 490. The refrigerant of the evaporator 424 may absorb heat from the washing water by exchanging heat with the heated washing water. The washing water may be cooled by the evaporator 424 and then discharged to the outside through the drain pump 1171.

The flow generator 493 may be provided inside the heat recover chamber 490. The flow generator 493 includes an impeller 4913 and a drive motor 4932 to drive the impeller 4913 so as to promote heat exchange between the refrigerant of the evaporator 424 and the heated washing water.

Accordingly, according to the present disclosure, water for heat transfer to refrigerant may be in contact with the evaporator 124 to exchange heat, and the flow generator 131 may generate a flow in the water, thereby promoting heat exchange between the water and the refrigerant of the evaporator 124.

Furthermore, since an evaporation temperature of the refrigerant of the evaporator 124 increases and a pressure of a compressor 121 decreases by promoting heat exchange between the water and the evaporator 124, a washing water heating temperature of the condenser 122 may increase by the same pressure of the compressor 121, thereby reducing washing water heating time.

In addition, the evaporator 124 and the impeller 1311 may be provided inside the heat exchange chamber 1311, and the flow generator 131 may rotate the impeller 1311 with the drive motor 1312 as a power source to flow water stored inside the heat exchange chamber 130 to be mixed evenly, thereby allowing the water to uniformly transfer heat to the evaporator 124.

Moreover, a plurality of guide members 150 may extend in a direction crossing a flow of refrigerant in the evaporator 124 to guide the water to go straight while crossing the refrigerant pipe 125 and uniformly distribute water to the zigzag-shaped (or serpentine-shaped) refrigerant pipe 125, thereby efficiently performing heat exchange between the water and the refrigerant.

Besides, a heat transfer passage may be disposed inside the heat exchange chamber 130, and the heat transfer passage may be disposed to extend in a zigzag shape in a direction crossing the refrigerant pipe 125 of the evaporator 124, thereby promoting heat exchange.

Furthermore, the heat transfer passage may include the inlet passage portion 161, the heat transfer portion 162, and the outlet passage portion 163, and water may deeply flow into an inner side of the heat exchange chamber 130 along the inlet passage portion 161, and return from an inlet side of the heat transfer portion 162, and move to an upstream side of the inlet passage portion 161 in a zigzag shape along the heat transfer portion 162 and then return again from an outlet side of the heat transfer portion 162, and move to the outlet port 1302 along the outlet passage portion 163 to be discharged, thereby extending heat exchange time between washing water to be discharged from the sump 114 and the evaporator 124 inside the heat recovery chamber 490 so as to recover the maximum amount of heat.

In particular, although the plurality of guide fins has been described as an example applied to the heat exchange chamber 130, it may also be applicable to the preheating chamber 390 or the heat recovery chamber 490. However, the plurality of guide pins may be more advantageous in case of being applied to the heat exchange chamber 130 and the preheating chamber 390 in which heat exchange is carried out while water or washing water is filled in a predetermined amount due to a structural feature.

In addition, although the heat transfer channel has been described as an example applied to the heat exchange chamber 130, it may also be applicable to the preheating chamber 390 or the heat recovery chamber 490. However, the heat transfer passage may be more advantageous when the heat transfer passage is applied to the heat recovery chamber 490 in which heat exchange is continuously carried out with the inflow and outflow of water or washing water due to the nature of a passage structure.

The first to fourth embodiments of the present disclosure may be applied independently or two or more embodiments may be combined. In particular, the plurality of guide members 150 or the heat transfer passage may be applicable to at least one or more of the first to fourth embodiments.

What is claimed is:

1. A dish washer, comprising:

a washing tank that defines an accommodation space configured to receive one or more objects to be washed, the washing tank comprising a sump disposed at a bottom surface of the washing tank;

a heat pump system comprising an evaporator, a compressor configured to compress and circulate refrigerant, a condenser configured to heat washing water for washing the one or more objects, and an expansion apparatus, the evaporator comprising a refrigerant pipe that is configured to carry the refrigerant therein and extends in a serpentine shape; and a heat exchange system configured to exchange heat between the evaporator and water supplied to the heat exchange system to thereby transfer heat to the refrigerant in the heat pump system, wherein the heat exchange system comprises a heat exchange chamber that accommodates the evaporator and is configured to receive water therein, the heat exchange system being configured to exchange heat between the refrigerant in the evaporator and the water received in the heat exchange chamber, wherein the heat exchange chamber comprises an inlet port, an outlet port spaced apart from the inlet port in a diagonal direction of the heat exchange chamber, and a heat transfer passage configured to guide water from the inlet port to the outlet port, wherein the heat transfer passage comprises:

a heat transfer portion that extends in a zigzag shape in a direction crossing the refrigerant pipe, an inlet passage portion configured to guide water received from the inlet port into the heat transfer portion, and an outlet passage portion configured to guide water received from the heat transfer portion to the outlet port, wherein the heat exchange system comprises a flow generator mounted to the heat exchange chamber and configured to generate water flow in the heat exchange chamber, and wherein the flow generator comprises an impeller configured to rotate to generate the water flow and a drive motor configured to drive the impeller.

2. The dish washer of claim 1, further comprising:

an injection arm disposed inside the washing tank, the injection arm comprising a plurality of nozzles configured to inject washing water to the one or more objects; and a circulation pump configured to circulate washing water in the sump to the injection arm.

3. The dish washer of claim 1, wherein the heat exchange system further comprises a water supply unit configured to supply water to the heat exchange chamber, wherein the inlet port is disposed at a first side of the heat exchange chamber and configured to receive water from the water supply unit, and wherein the outlet port is disposed at a second side of the heat exchange chamber and configured to discharge water from the heat exchange chamber.

4. The dish washer of claim 3, wherein the heat exchange system further comprises:

a water pipe connected to the inlet port of the heat exchange chamber and configured to supply water to the heat exchange chamber;

a water inlet valve disposed at the water pipe and configured to open and close the water pipe;

an outlet pipe connected to the outlet port of the heat exchange chamber and configured to discharge water from the heat exchange chamber; and a water outlet valve disposed at the outlet pipe and configured to open and close the outlet pipe.

5. The dish washer of claim 1, further comprising:

an electric heater configured to heat washing water to be supplied to the washing tank.

6. The dish washer of claim 1, wherein the condenser is disposed in the sump and configured to heat washing water in the sump.

7. The dish washer of claim 1, further comprising:

a preheating chamber that is configured to receive washing water and that accommodates the condenser therein, the condenser being configured to preheat washing water in the preheating chamber prior to supply the washing water to the washing tank;

a preheating impeller rotatably mounted inside the preheating chamber and configured to generate a flow of washing water in the preheating chamber; and a preheating drive motor configured to drive the impeller.

8. The dish washer of claim 1, further comprising:

a drain pipe configured to discharge washing water to an outside of the dish washer, wherein the heat exchange chamber is configured to receive washing water from the sump, the heat exchange chamber having a first side that is connected to and in communication with the sump and a second side that is connected to and in communication with the drain pipe, and wherein the heat exchange chamber is configured to exchange heat between the evaporator and washing water received from the sump to thereby recover heat from the washing water received from the sump prior to discharging the washing water to the outside of the dish washer.

9. The dish washer of claim 8, wherein the impeller is rotatably mounted inside the heat exchange chamber.

10. The dish washer of claim 1, further comprising a controller configured to control the flow generator.

11. The dish washer of claim 1, wherein the heat transfer portion extends across a plurality of portions of the refrigerant pipe.

12. The dish washer of claim 1, wherein the inlet port is defined at a lower portion of a first side of the heat exchange chamber, and wherein the outlet port is defined at an upper portion of a second side of the heat exchange chamber opposite to the first side of the heat exchange chamber.

13. The dish washer of claim 12, wherein the inlet passage portion extends in a horizontal direction from the lower portion of the first side of the heat exchange chamber to a lower portion of the second side of the heat exchange chamber, and wherein the outlet passage portion extends in the horizontal direction from an upper portion of the first side of the heat exchange chamber to the upper portion of the second side of the heat exchange chamber.

14. The dish washer of claim 12, wherein the impeller is disposed at a lower portion of the second side of the heat exchange chamber and configured to rotate about a rotary shaft extending toward the inlet port.

* * * * *